United States Patent [19]

Takahashi et al.

[11] 4,313,770

[45] Feb. 2, 1982

[54] METHOD OF PRODUCING COLD ROLLED STEEL STRIP HAVING IMPROVED PRESS FORMABILITY AND BAKE-HARDENABILITY

[75] Inventors: Masashi Takahashi, Kawanishi; Atsuki Okamoto, Ashiya, both of Japan

[73] Assignee: Sumitomo Metal Industries, Ltd., Osaka, Japan

[21] Appl. No.: 159,346

[22] Filed: Jun. 13, 1980

[30] Foreign Application Priority Data

Jun. 28, 1979 [JP] Japan ..... 54-82510
Jun. 28, 1979 [JP] Japan ..... 54-82511

[51] Int. Cl.[3] ..... C21D 9/46; C21D 9/48
[52] U.S. Cl. ..... 148/12 C
[58] Field of Search ..... 148/12 C, 12.3

[56] References Cited

U.S. PATENT DOCUMENTS

| | | | |
|---|---|---|---|
| 3,239,390 | 3/1966 | Matsukura et al. | 148/12 C |
| 3,853,639 | 12/1974 | Hughes | 148/12 C |
| 3,879,232 | 4/1975 | Gondo et al. | 148/12 C |
| 3,897,280 | 7/1975 | Gondo et al. | 148/12 C |
| 3,912,549 | 10/1975 | Gondo et al. | 148/12 C |
| 3,928,083 | 12/1975 | Gondo et al. | 148/12 C |

FOREIGN PATENT DOCUMENTS

| | | | |
|---|---|---|---|
| 52-23519 | 2/1977 | Japan | 148/12 C |

*Primary Examiner*—W. Stallard
*Attorney, Agent, or Firm*—Stevens, Davis, Miller & Mosher

[57] ABSTRACT

A method of producing a cold rolled steel strip having improved press formability and bake-hardenability is disclosed. The steel consists essentially of:

C: 0.003–0.150%,
Si: not more than 1.50%,
Mn: 0.03–0.25%,
P: 0.03–0.20%,
sol. Al: 0.02–0.15%,
N: 0.002–0.015%,
balance being iron and incidental impurities.

The method comprises hot rolling, pickling, cold rolling, then passing the resulting steel strip to a box annealing furnace in which the steel strip is subjected to recrystallization annealing by heating it at a temperature lower than 760° C. but higher than the recrystallization temperature of the steel in a steel composition area comprised of a single phase of ferrite or a dual phase of ferrite plus austenite in the Fe-C binary phase diagram and cooling it in the temperature range of from 500° C. to 200° C. at an average cooling rate of 10°–250° C./hr, and then temper rolling the annealed steel strip.

7 Claims, 9 Drawing Figures

METHOD OF PRODUCING COLD ROLLED STEEL STRIP HAVING IMPROVED PRESS FORMABILITY AND BAKE-HARDENABILITY

FIELD OF THE INVENTION

This invention relates to a method of producing a cold rolled steel strip having excellent press formability, which is hardenable during baking of a paint applied thereto resulting in a high level of strength.

The cold rolled steel strip produced in accordance with this invention is particularly suitable for manufacturing outer and inner panels of automobile bodies and may contribute to reduce the weight of automobiles with improvement in mileage economy.

PRIOR ART

With the recent trend to reduce the weight of automobiles in an attempt to improve mileage economy, the auto industry demands manufacturing the outer and inner panels from a steel strip which is as thin as possible. If the outer panel is made from a thin steel strip, it is necessary to provide the strip with improved dent resistance, i.e. the resistance to permanent deformation which is caused when the outer panel is pressed with a finger or hit by a bouncing pebble. The higher the Y.P. (yielding point) of the strip, the higher the dent resistance.

As is well known in the art, since this type of steel strip is subjected to a high degree of press forming, the strip must have sufficient press formability to prevent the development of wrinkles and cracks during press forming. The steel strip should have excellent shape fixability, i.e. a strip blank should fit well with press dies and not result in spring back after it is removed from the dies. The press formability and shape fixability are evaluated in terms of a high r-value (Lankford value) and low Y.P. Therefore, a cold rolled steel strip to be used for that purpose should have a high r-value and low Y.P. prior to the press forming and should have a high Y.P. after press forming and paint-baking.

It is possible to increase Y.P. to some extent by applying press forming to the steel strip due to the introduction of strains. However, the thus introduced strains are not distributed uniformly throughout the product. Therefore, it is impossible to obtain uniform and sufficient increase in Y.P. throughout the product only by press forming. The panels of automobile in most cases is coated with a paint and baked after press forming. This baking means heating the strip at about 140°–200° C. for about 10–30 minutes after being press formed. In order to provide a steel strip having improved dent resistance, therefore, it is desired that Y.P. increases in the course of heat treatment above.

In general, Al-killed steel strips produced in accordance with the conventional process including box annealing has a high r-value and a low Y.P., with satisfactory press formability and shape fixability. However, they do not exhibit any bake-hardenability, and therefore, they do not make any contribution to the attempt to reduce the weight of automobile. On the other hand, rimmed steel strips and steel strips having been subjected to continuous annealing can exhibit bake-hardenability resulting in satisfactory dent resistance in a final product. However, since these steel strips have in general a low r-value and undergo aging at room temperature, the press formability is not satisfactory resulting in the development of cracks and wrinkles or furrowed surface roughening called stretcher strains during press forming. Therefore, this type of steel strip is not suitable for manufacturing outer panels of automobile.

The phenomenon of bake-hardenability can be explained by the age-hardening of steel due to the precipitation of carbon dissolved in ferrite. Aging of steel due to carbon precipitation has been studied by a large number of researchers for a long time. See, for example, a series of articles reported in "IRON & STEEL" May 1963 pp. 186–192, June 1963 pp. 326–334, July 1963 pp. 368–374, August 1963 pp. 400–405 and September 1963 pp. 450–457.

It may be possible to utilize the strain aging so as to improve the strength of steel. However, in case of cold rolled steel strip for automobile, aging at room temperature must be avoided, since it should have satisfactory press formability, i.e. low strength at room temperature. The aging which results in increase in strength should take place only in the course of baking including heating the strip at an elevated temperature for a certain period of time. For this purpose it is necessary to precisely control the amount of carbon kept in solid solution. However, it has been thought that it is difficult to do so in a practical method of producing a cold rolled steel strip.

Japanese Patent Publication No. 17011/1975 discloses a cold rolled steel strip for automobile. The steel strip disclosed therein, however, utilizes nitrogen as an age-hardening element with a great tendency to result in aging at room temperature. In addition, since it contains tungsten and/or molybdenum, this type of steel strip is relatively expensive and of a relatively low strength.

Japanese Patent Publication No. 30528/1976 also discloses a cold rolled steel strip. However, this steel strip contains zirconium and has low strength. In addition, this steel is essentially accompanied by age-hardening at room temperature.

Since this type of cold rolled steel strip is predominantly used for manufacturing outer and inner panels of automobile bodies, the strip should be mass-produced and less expensive. Furthermore, as stated hereinbefore, the steel strip for automobile should have improved press formability and the aging at room temperature should be eliminated. Therefore, a satisfactory cold rolled steel strip for automobile has not yet been provided in the prior art.

BRIEF DESCRIPTION OF THE INVENTION

The primary object of this invention is to provide a method of producing a cold rolled steel strip having excellent press formability and bake-hardenability for use in manufacturing particularly outer and inner panels of automobile bodies.

Another object of this invention is to provide a method of producing a cold rolled steel strip for use in producing particularly outer and inner panels of automobile bodies, the steel strip having improved press formability and hardenable during baking of a paint applied thereto resulting in a high level of strength.

Still another object of this invention is to provide a method of producing cold rolled steel strip having improved press formability, shape fixability, and bake-hardenability without being accompanied by aging at room temperature.

The inventors of this invention, after carrying out extensive study and experiments with the aims above in mind, succeeded in providing a cold rolled steel strip free from aging at room temperature but having improved bake-hardenability by adjusting the steel composition as well as the box annealing conditions.

Thus, this invention is based on the finding that if a steel composition, particularly including amounts of carbon, manganese and phosphorus, and if necessary, of silicon, is adjusted to a proper one and box annealing conditions are also adjusted to proper ones depending on the steel composition, preferably on the carbon content, a proper amount of carbon may easily and successfully be kept in solid solution upon cooling in box annealing and this dissolved carbon is effective for making the steel strip non-aging at room temperature and providing it with bake-hardenability.

According to the conventional method, the carbon dissolved upon heating to a temperature of 600°–750° C. in box-annealing will mostly precipitate as $Fe_3C$ upon cooling. The amount of carbon kept in solid solution at room temperature is supposed to be less than 1 ppm. An Al-killed steel strip produced by the conventional method, therefore, does not exhibit aging at room temperature nor bake-hardenability.

On the contrary, according to this invention, the manganese content is limited to be low and the phosphorous content to be high. The soaking temperature and cooling conditions upon annealing are precisely determined by the carbon content. Therefore, according to this invention, the precipitation of $Fe_3C$ is suppressed upon cooling such that carbon in an amount of 1–15 ppm is kept in solid solution at room temperature. The carbon dissolved in this level makes the steel strip non-aging at room temperature but it is effective to make it baking hardenable. It will be hardened when heated at such an elevated temperature as in the baking. When the steel strip is heated at such a high temperature, carbon is segregated along the dislocation lines, which have been introduced during press forming, resulting in increase in Y.P. of the product by 2–7 $kg/mm^2$.

DETAILED DESCRIPTION OF THE INVENTION

In a broad aspect, this invention resides in a method of producing a cold rolled steel strip having improved press formability and bake-hardenability, in which the steel consists essentially of:

C: 0.003–0.150%,
Si: not more than 1.50%, preferably not more than 0.20%,
Mn: 0.03–0.25%,
P: 0.03–0.20%,
sol.Al: 0.02–0.15%,
N: 0.002–0.015%, balance being iron and incidental impurities comprising hot rolling, pickling, cold rolling, then passing the resulting steel strip to a box annealing furnace in which the steel strip is subjected to recrystallization annealing by heating it at a temperature lower than 760° C. but higher than the recrystallization temperature of the steel in a steel composition area comprised of a single phase of ferrite or a dual phase of ferrite plus austenite in the Fe-C binary phase diagram and cooling it in the temperature range of from 500° C. to 200° C. at an average cooling rate of 10°–250° C./hr, and then temper rolling the annealed strip.

Figure 1:
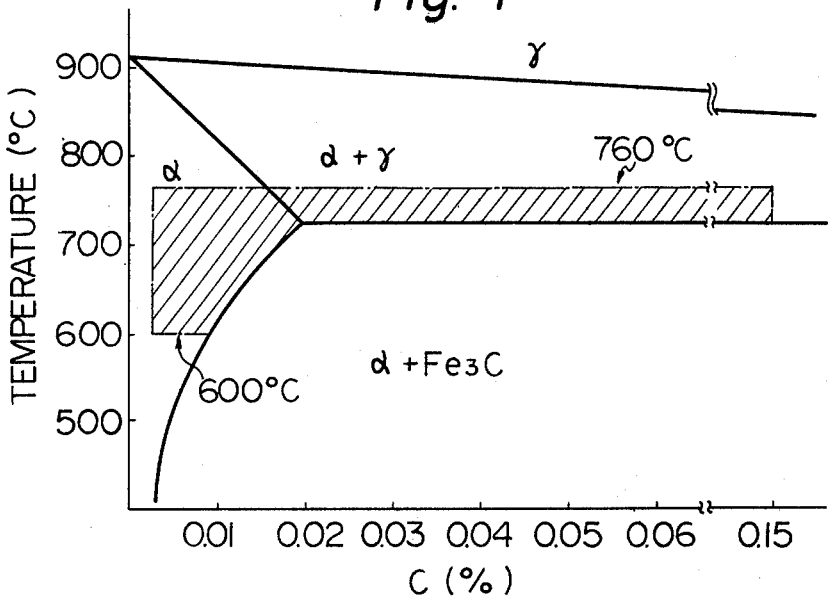
FIG. 1 is a part of the Fe-C phase diagram indicating the relation between the carbon content and the soaking temperature in this invention.

Now referring to FIG. 1, the hatched area means the area composed of a single phase of ferrite or a dual phase of ferrite plus austenite within the temperature range of lower than 760° C. but higher than the recrystallization temperature in the above.

In a preferred embodiment, when the carbon content is 0.003–0.020%, the cold rolled steel strip is box-annealed under the conditions including heating at 600°–760° C. and cooling in the temperature range of from 400° C. to 200° C. at an average cooling rate of 10°–250° C./hr.

Therefore, this invention also resides in a method of producing a cold rolled steel strip having improved press formability and bake-hardenability, in which the steel consists essentially of:

C: 0.003–0.020%,
Si: not more than 1.50%, preferably not more than 0.20%,
Mn: 0.03–0.25%,
P: 0.03–0.20%,
sol. Al: 0.02–0.15%,
N: 0.002–0.015%, balance being iron and incidental impurities comprising hot rolling, pickling, cold rolling, then passing the resulting steel strip to a box annealing furnace in which the steel strip is subjected to recrystallization annealing by heating it at a temperature of from 600°–760° C. and cooling it in the temperature range of from 400° C. to 200° C. at an average cooling rate of 10°–250° C./hr, and then temper rolling the annealed steel strip.

The steel composition of this invention in this case preferably consists essentially of:

C: 0.003–0.020%,
Si: 0.04–0.20%,
Mn: 0.03–0.20%,
P: 0.04–0.20%,
sol. Al: 0.02–0.15%,
N: 0.002–0.015%, balance being iron and incidental impurities.

In another embodiment, when the carbon content is 0.020–0.150%, the cold rolled steel strip is box-annealed under the conditions including heating at 720°–760° C. and cooling it in the temperature range of from 500° C. to 200° C. at an average cooling rate of 25°–250° C./hr.

Therefore, this invention also resides in a method of producing a cold rolled steel strip having improved press formability and bake-hardenability, in which steel consists essentially of:

C: 0.020–0.150%,

Si: not more than 1.50%, preferably not more than 0.20%,
Mn: 0.30–0.25%,
P: 0.03–0.20%,
sol. Al: 0.02–0.15%,
N: 0.002–0.015%, balance being iron and incidental impurities comprising hot rolling, pickling, cold rolling, then passing the resulting steel strip to a box annealing furnace in which the steel strip is subjected to recrystallization annealing by heating it at a temperature of 720°–760° C. and cooling it in the temperature range of from 500° C. to 200° C. at an average cooling rate of 25°–250° C./hr, and then temper rolling the annealed steel strip.

The steel composition of this invention in this case preferably consists of:

C: 0.020–0.150%,
Si: 0.04–0.20%,
Mn: 0.03–0.20%,
P: 0.04–0.20%,
sol. Al: 0.02–0.15%,
N: 0.002–0.015%, balance being iron and incidental impurities.

In still another embodiment, the steel composition may further contain at least one of 0.003–0.030% Nb and 0.005–0.030% V with the total amount being not more than 0.030%.

Therefore, this invention also resides in a method of producing a cold rolled steel strip having improved press formability and bake-hardenability, in which the steel consists essentially of:

C: 0.02–0.150%,
Si: not more than 1.50%, preferably not more than 0.20%,
Mn: 0.03–0.25%,
P: 0.03–0.20%,
sol. Al: 0.02–0.15%,
N: 0.002–0.015%,
at least one of 0.003–0.030% Nb and 0.005–0.030% V, in total not more than 0.030%, balance being iron and incidental impurities, comprising hot rolling, pickling, cold rolling, then passing the resulting steel strip to a box annealing furnace in which the steel strip is subjected to recrystallization annealing by heating it at a temperature of 720°–760° C. and cooling it in the temperature range of from 500° C. to 200° C. at an average cooling rate of 25°–250° C./hr, and then temper rolling the annealed steel strip.

In this case the steel composition preferably consists essentially of:

C: 0.02–0.150%,
Si: 0.04–0.20%,
Mn: 0.03–0.20%,
P: 0.04–0.20%,
sol. Al: 0.02–0.15%,
N: 0.002–0.015%,
at least one of 0.003–0.03% Nb and 0.005–0.030% V, in total not more than 0.030%, balance being iron and incidental impurities.

In general, 100–200 ppm of carbon dissolves during the soaking of recrystallization annealing and most of the thus dissolved carbon will precipitate as $Fe_3C$ in the course of cooling. As already stated, according to this invention the colling rate in the temperature range of from 500° C. (or 400° C.) to 200° C. is controlled so that an adequate amount of carbon is kept in solid solution at room temperature. Precipitation of carbon takes place continuously in the course of cooling from the soaking temperature (maximum heating temperature) to 200° C. However, according to this invention it was found that control of the cooling rate in the temperature range from 500° C. (or 400° C.) to 200° C. is sufficient to control the amount of carbon dissolved at room temperature after cooling.

When the cooling rate is higher than 250° C./hr in the temperature range above, much carbon is kept in solid solution. Since the thus dissolved carbon is unstable, it easily precipitates to cause aging at room temperature. Therefore, a cooling rate higher than 250° C./hr is not desirable. On the other hand, when the cooling rate is lower than 10° C./hr, precipitation of carbon is substantially completed in the course of cooling, even if the steel composition and the soaking temperature are controlled as in this invention. Since a substantial amount of carbon cannot be maintained in solid solution after cooling, the resulting steel does not have bake-hardenability. In a preferred embodiment, the lower limit of the cooling rate depends on the carbon content. Namely, the lower limit is preferably 10° C./hr for a steel containing not more than 0.02% C. and 25° C./hr for a steel containing more than 0.02% C. In the latter case (medium carbon steel), precipitation of carbon mainly starts from massive $Fe_3C$, which acts as nucleus for precipitation and is concentrated in the crystal grain boundries. Therefore, the cooling rate should be higher than the speed at which carbon atoms within crystal grains diffuse to the grain boundry. Thus, a cooling rate higher than 25° C./hr is desired for the purpose of this invention. In the former case (low carbon steel), since the carbon content is low, $Fe_3C$ as a nucleus for precipitation does not form to any appreciable extent. Therefore, the dissolved carbon itself has to precipitate as $Fe_3C$. The precipitation of $Fe_3C$ in this manner requires some energy. This means that the precipitation of carbon in this case takes place slowly without being substantially influenced by a cooling rate as low as 10° C./hr, resulting in an adequate amount of carbon kept stable in solid solution.

The relation between the carbon content of the steel of this invention and the box-annealing conditions will be described in further detail hereunder.

(1) In the case of the carbon content being 0.003–0.020%:

In this case the maximum soaking temperature should be higher than the recrystallization soaking temperature and preferably it should be higher than 600° C. so that recrystallization may thoroughly take place and as much carbon as possible may be dissolved.

If the cooling rate is lower than 10° C./hr, a necessary amount of carbon cannot be kept in solid solution at room temperature. However, if the cooling rate is higher than 250° C./hr, then much carbon in solid solution is brought in at room temperature.

The cooling rate above is preferably defined and controlled as the average cooling rate in the temperature range of from 400° C. to 200° C. This is because, as mentioned hereinbefore, the cooling rate in this temperature range has a great influence on the precipitation of $Fe_3C$, which, in turn, is closely related to the amount of carbon kept in solid solution at room temperature.

(2) In the case of the carbon content being 0.020–0.150%:

In this case the soaking temperature in box-annealing is raised to a point within the $(\alpha+\gamma)$ binary phase area in the Fe-C phase diagram (see FIG. 1) so that most of the carbon in the steel may be dissolved in the $\gamma$-phase (austenite) formed during the soaking to prevent the presence of fine $Fe_3C$ (cementite) particles within ferrite grains. If the steel is cooled gradually from this metallographical state, the precipitation of the dissolved carbon (about 0.02%) does not occur so much resulting in a suitable amount of carbon kept in solid solution at room temperature. This causes bake-hardenability. The soaking temperature of box-annealing is 720°–760° C. in the $(\alpha+\gamma)$ binary phase area. When the soaking temperature is lower than 720° C., the $\gamma$-phase does not form, allowing the presence of a large amount of fine $Fe_3C$ particles within a crystal grain after cooling the cold rolled steel strip. Therefore, the carbon dissolved during soaking is all precipitated in the course of cooling resulting in non bake-hardenability. On the other hand, when the soaking temperature is higher than 760° C., since the volume of $\gamma$-phase increases with increase in temperature, the concentration of carbon in the $\gamma$-phase decreases resulting in the tendency to precipitate pearlite (lamellar aggregate ferrite and cementite). It is rather difficult to obtain massive $Fe_3C$. Therefore, the dissolved carbon easily precipitates in the course of cooling. This is not desired for bake-hardenability.

The cooling rate is also controlled for the purpose of optimizing the amount of carbon kept in solid solution at room temperature after annealing. If the cooling rate in the temperature range of from 500° C. to 200° C. is lower than 25° C./hr, the carbon migrates and precipitates around $Fe_3C$ particles in the grain boundaries even in the case that there are no $Fe_3C$ particles within the grains. This results in decrease in the amount of dissolved carbon. If the cooling rate is over 250° C./hr, the cooling is too rapid and the dissolved carbon cannot precipitate. Therefore, much carbon inevitably remains dissolved at room temperature resulting in aging at room temperature.

The temperature range on the basis of which the cooling rate is defined in this invention is 500°–200° C. The reason why the temperature range is defined as 500°–200° C. is that the precipitation of carbon vigorously occurs in this temperature range.

In both cases (1) and (2) above, after annealing the resulting steel strip is subjected to temper rolling with a reduction of 0.5–2.0% so as to avoid the development of yield point elongation (Y.P.E.) during press forming.

Now the reason for defining the steel composition of this invention will be described.

According to this invention, as a broad aspect, the carbon content is defined as 0.003–0.150%. When the carbon content is less than 0.003%, much phosphorus segregates in the crystal grain boundaries, sometimes resulting in brittle fracture of the steel. On the other hand, when the carbon content is more than 0.150%, so much massive $Fe_3C$ precipitates that a suitable amount of carbon cannot be maintained in solid solution at room temperature. Bake-handenability in such a degree as required for the purpose of this invention cannot be obtained.

Silicon acts to suppress the precipitation of $Fe_3C$ in the course of cooling. The addition of Si increases the amount of carbon dissolved in solid solution. The higher the silicon content the stronger this effect. However, when the silicon content is more than 0.2%, the surface properties of the resulting steel strip are impaired with an appearance of uneven color. Since the improved surface properties are not required for the material used for making inner panels of automobiles, the steel strip for use in such applications may contain less than 1.50% Si. If the respective contents of C, Mn and P are precisely controlled, the addition of Si is not always necessary. But it is preferable to incorporate silicon in an amount of more than 0.04% in order to obtain improved bake-hardenability.

The addition of manganese accelerates the precipitation of $Fe_3C$ in the course of cooling and also reduces the amount of carbon dissolved in solid solution after annealing. The manganese content is restricted to not more than 0.25% in this invention. Manganese in a smaller amount than 0.20% is preferable. When the manganese content is higher than 0.25%, satisfactory bake-hardenability cannot be obtained. On the other hand, when it is lower than 0.03%, red shortness will result in the presence of sulfur. Manganese preferably is contained in an amount of 0.03–0.20%.

In this respect, since silicon is effective to improve bake-hardenability, as hereinbefore mentioned, a low-manganese, high-silicon steel is preferable to achieve markedly high bake-hardenability.

Phosphorus is added as an essential element in this invention. The addition of phosphorus is important because it may improve both non-aging property and bake-hardenability. In the absence of P, the dissolved carbon, even if its amount is small, causes aging at room temperature. This is because carbon is segragated along the dilocation lines introduced during temper rolling. If phosphorus is added, a lattice surrounding the phosphorus atom is warped and carbon atoms are trapped in this warped area. The trapped carbon atoms are metastable so that they do not segragate along the dislocation lines at room temperature even after temper rolling, making the steel non-aging at room temperature. However, the carbon atoms trapped by phosphorus atoms, when heated at a temperature as high as 170° C., easily leave to segregate along the dislocation lines resulting in aging, i.e. bake-hardening. Therefore, the addition of more than 0.03% P is necessary for the purpose of this invention. However, the addition of phosphorus in an amount of more than 0.20% degrades spot weldability. Therefore, this invention restricts the content of phosphorus to 0.03–0.20%. Preferably, the amount of phosphorus added is more than 0.04%.

The addition of sol. Al in an amount of more than 0.02% is necessary for the following two reasons. One reason is that the sol. Al in the steel fixes N and AlN to suppress the aging at room temperature. The other reason is that the presence of sol. Al serves to simultaneously cause the recrystallization of cold rolled structure and the precipitation of AlN in the course of heating in annealing, resulting in cold rolled steel strip having a high r-value and thus improved press formability. The content of sol. Al is restricted to 0.02–0.15%. The presence of sol. Al in an amount of more than 0.15%, does not bring so much improvement and increases the manufacturing cost of the steel.

The nitrogen content is restricted to 0.002–0.015%. When nitrogen is less than 0.002%, the synergistic effect of sol. Al and nitrogen cannot be obtained. If it is added in an amount of more than 0.015%, then satisfactory elongation cannot be obtained.

The annealing following cold rolling is preferably box annealing. The box annealing is effective to provide improvement in recrystallization texture due to its inherent slow heating and is also effective to keep a proper amount of carbon in solid solution at room temperature due to its inherent slow cooling. The cold rolled steel strip may be annealed in an open coil or in a tight coil. A decarburizing atmosphere might reduce the carbon content of the steel being treated, e.g. the carbon content of the steel might be reduced to 0.003% or less particularly in case of lowcarbon cold rolled steel strip of this invention, resulting in brittle fracture of the steel due to segragation of phosphorus along the grain boundaries. Thus, it is preferred to carry out the annealing at a non-decarburization atmosphere.

As hereinbefore mentioned, according to this invention, by employing the steel composition mentioned above, a cold rolled steel strip having yield point of 25–40 kg/mm$^2$ after baking can be obtained. Since this type steel does not contain any expensive elements, the steel strip of this invention is advantageous from an economic viewpoint.

However, if a further improvement in strength is desired, it may be possible to incorporate some additional elements, though the addition of these elements make the steel more expensive. Thus, according to another embodiment of this invention, the following elements may be incorporated in a steel containing 0.020–0.150%C.:

Nb: 0.003–0.030%,

V: 0.005–0.030%,

At least one of these elements may be incorporated in the steel strip of this invention. The amount is in total not more than 0.030%. The manufacturing process to be applied to steel containing at least one of Nb and V is preferably the same as that applied to steel containing 0.020–0.150%C. According to this embodiment of this invention, cold rolled steel strip of high strength having a yield point of 30–50 kg/mm$^2$ after baking can be obtained.

Improving the strength of steel by the addition of Nb and V has been tried, since it has been known in the art that these elements are effective for precipitation strengthening and fine grain strengthening. However, the cold rolled steel having improved strength due to precipitation hardening inevitably exhibits low elongation and low r-value resulting in poor press formability. Therefore, it has been thought that the addition of Nb and V is not allowed for the purpose of providing steel strip having improved strength as well as improved press formability.

However, according to this invention utilizing particular steel composition and annealing conditions, it has been found that it is possible to obtain cold rolled steel strip having tensile strength of higher than 40 kg/mm$^2$ and satisfactory press formability and shape fixability with the addition of Nb and/or V. Moreover, the thus resulting steel strip shows remarkable bake-hardenability. Namely, by specifying the respective contents of C, Mn, P, Si and sol. Al as well as the annealing conditions, it is possible to utilize only the fine grain strengthening property which the addition of Nb (or V) induces without adversely affecting the elongation and r-value to any extent.

If a steel strip containing Nb and/or V is box-annealed at a temperature of 630°–700° C. as usual, $Fe_3C$, NbC, NbN, VC and VN precipitate in fine particles, resulting in less elongation and substantially no bake-hardenability. However, if it is box-annealed at a temperature higher than 720° C., these precipitates grow coarse and the bake-hardenability and elongation are improved. On the other hand, it is box annealed at a temperature higher than 760° C., the $Fe_3C$ grows too large, reducing the bake-hardenability. As hereinbefore described, it is necessary to cool the heated steel strip at a moderate rate in order to keep a proper amount of carbon in solid solution at room temperature, which remains without suffuring from precipitation during press forming, but precipitates upon baking to cause hardening. The cooling rate for this purpose is, as already defined, is 25°–250° C./hr in the temperature range of from 500° C. to 200° C.

Silicon may be added to the steel containing Nb and/or V to improve its bake-hardenability and strength. However, when the amount of silicon added is more than 0.2%, the surface properties of the resulting steel strip are impaired to some extent with an appearance of uneven color. Since the improved surface properties are not required for the material used for making inner panels of automobiles, the steel strip for use in such applications may contain less than 1.50% Si.

EXAMPLE 1

Steels having the following composition were prepared and the resulting steels were subjected to hot rolling, pickling, cold rolling, box-annealing and temper rolling.

C: 0.001–0.050%,

Si: 0.01–0.20%,

Mn: 0.10–0.20%,

P: 0.04–0.07%, sol. Al: 0.03–0.60%,

N: 0.006–0.009%,

The finishing temperature of hot rolling was 850° C., and the coiling temperature was 580° C. The reduction in thickness in cold rolling was from 2.8 mm to 0.8 mm with a reduction in thickness of 71%. The annealing conditions included heating at a rate of 50° C./hr, soaking at 700° C. or 740° C. for 5 hours and cooling at a rate of 50° C./hr. Elongation given by temper rolling was 1.2%.

Figure 2:
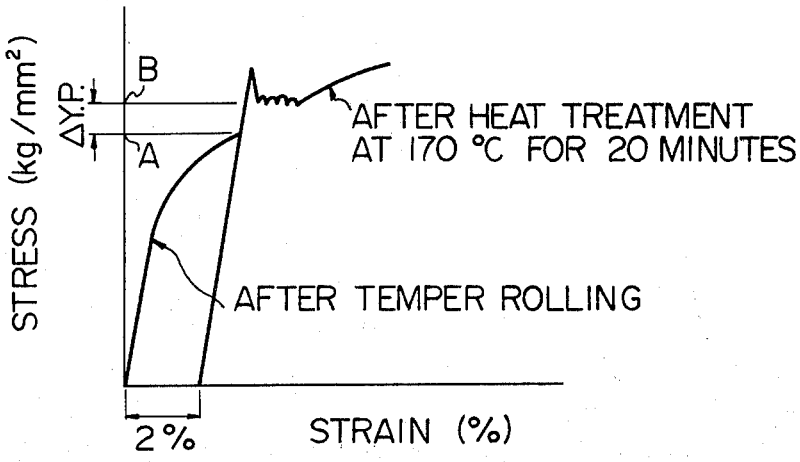
FIG. 2 is a stress-strain curve showing how to determine ΔY.P.

JIS No. 5 test pieces were cut from each of the resulting steel strips. The test pieces were at first elongated to give a permanent elongation of 2%. The flow stress A of the test pieces was determined from the result of this tensile test as shown in FIG. 2. The test pieces were unloaded and then heat treated at 170° C. for 20 minutes under conditions corresponding to those used in the baking process. After this heat treatment, the test pieces were subjected to the tensile test and the yielding stress B was determined as shown in FIG. 2. The calculated difference ($\Delta Y.P = B - A$) was treated as the amount of hardening due to baking.

Figure 3:
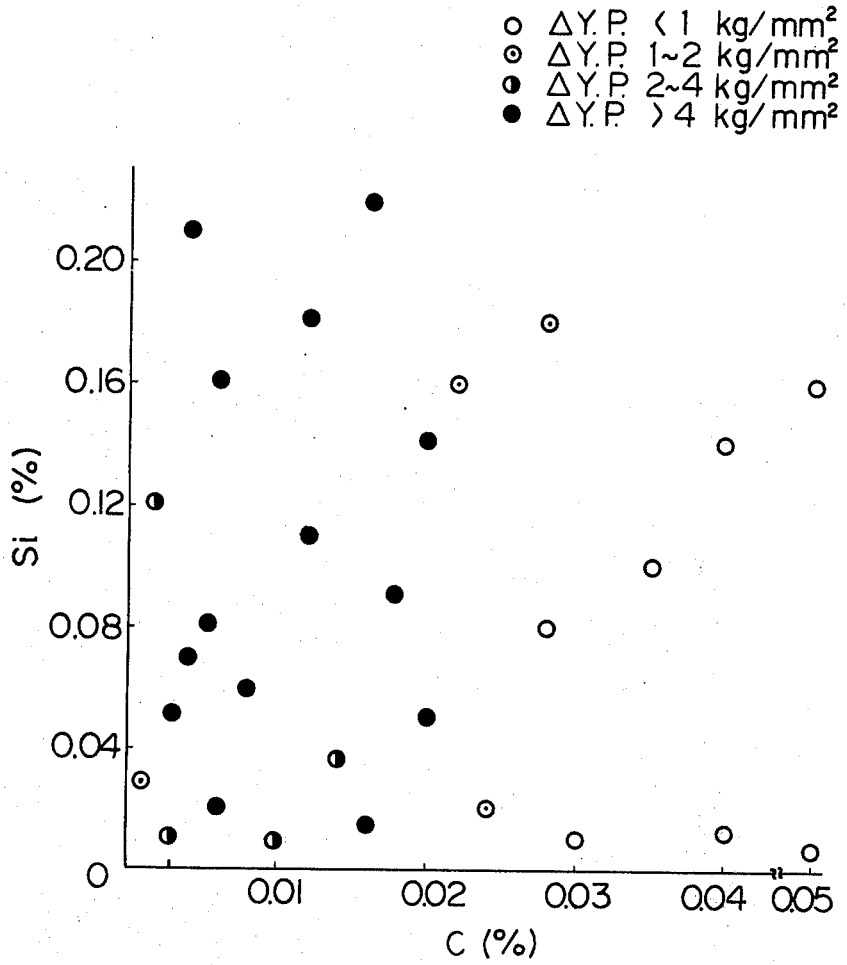
FIGS. 3 and 4 are graphs plotting the data of ΔY.P. with respect to the silicon content and the carbon content.
Figure 4:
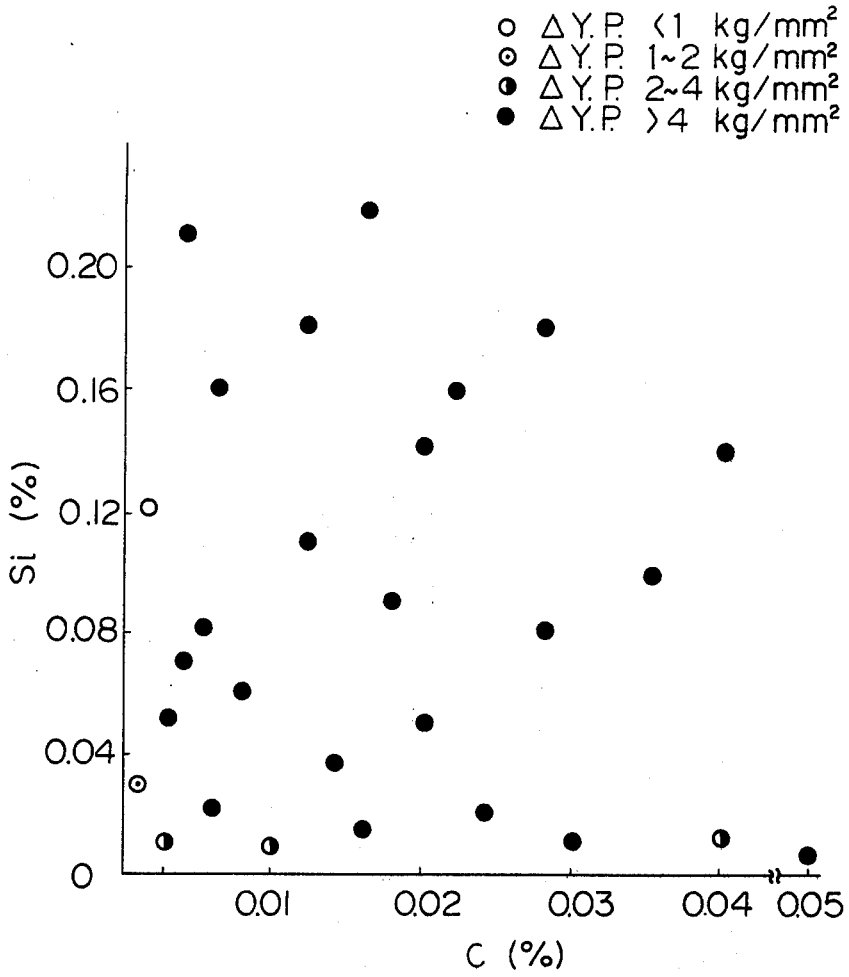

Results of a series of these tests in the above are summarized in FIGS. 3 and 4, in which the relations of C% and Si% with $\Delta Y.P.$ are illustrated. The soaking temperature was 700° C. in FIG. 3 and 740° C. in FIG. 4.

As shown in FIG. 3, all the specimens the steel composition of which falls within the range of the present invention (C: 0.003–0.020%, Si: not more than 0.20%) have $\Delta Y.P.$ of over 2 kg/mm$^2$, particularly the specimens containing more than 0.04% Si have $\Delta Y.P.$ of over 4 kg/mm$^2$.

As shown in FIG. 4, it is noted that even the steel containing more than 0.020% C. has $\Delta Y.P.$ of more than 2 kg/mm$^2$.

In order to measure the room temperature aging, accelerated aging was applied to the steel strip after temper rolling by heating it at 50° C. for 3 days. Yield point elongations were determined in the tensile test on the thus aged steel strip. The yield point elongations were all less than 0.5%, indicating that the steel strip of the present invention is non-aging at room temperature.

EXAMPLE 2

In this example, Example 1 was repeated except that the steel composition was:

C: 0.005–0.020%,
Si: 0.04–0.08%,
S: 0.008–0.015%,
sol. Al: 0.03–0.06%,
N: 0.006–0.009%,
Mn: 0.02–0.50%,
P: 0.007–0.10%, In this example, the soaking temperature in box annealing was 700° C.

Figure 5:
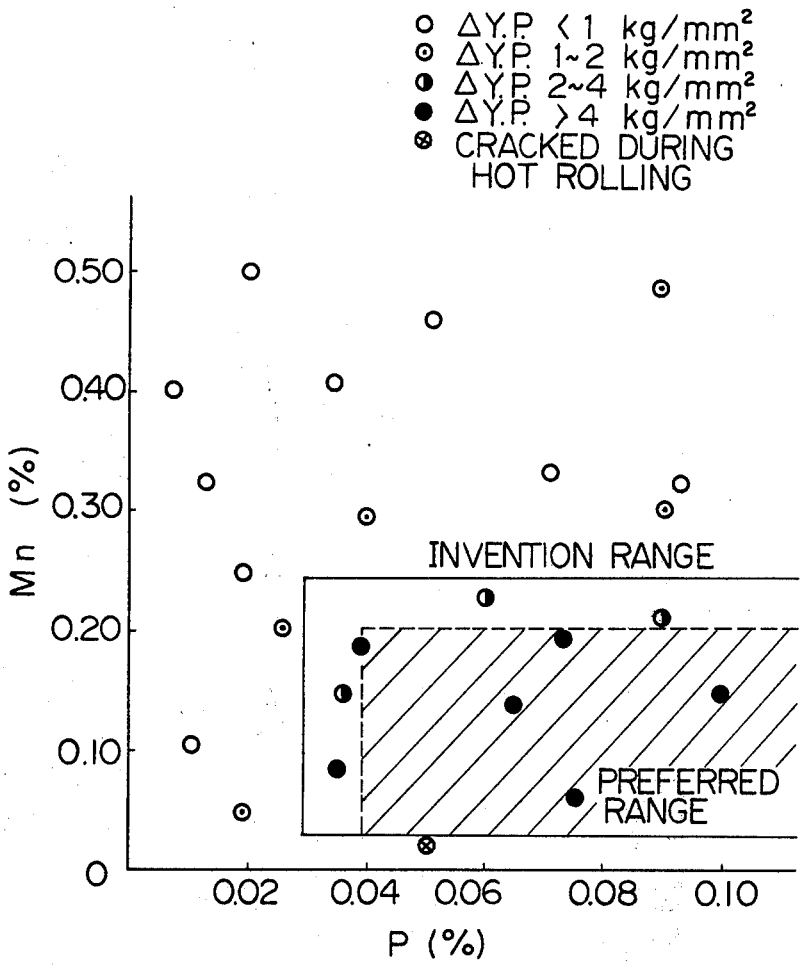
FIGS. 5 and 6 are also graphs plotting the data of ΔY.P. with respect to the manganese content and the phosphorus content.

The results of the amount of hardening due to baking (ΔY.P.) are summarized in FIG. 5 with respect to P% and Mn%, respectively. As is shown in FIG. 5, the steel strip having the steel composition falling within the steel composition of the present invention all shows ΔY.P. of more than 2 kg/mm$^2$. It can be said that ΔY.P. is always more than 4 kg/mm$^2$ in case phosphorus is more than 0.04% and manganese is less than 0.20%.

EXAMPLE 3

In this example, Example 1 was repeated except that the steel composition was:

C: 0.04–0.06%,
Si: 0.02–0.08%,
S: 0.006–0.018%,
sol. Al: 0.03–0.06%,
N: 0.004–0.009%,
Mn: 0.04–0.50%,
P: 0.006–0.10%

In this example the soaking temperature in box annealing was 740° C. The results are summarized in FIG. 6.

Figure 6:
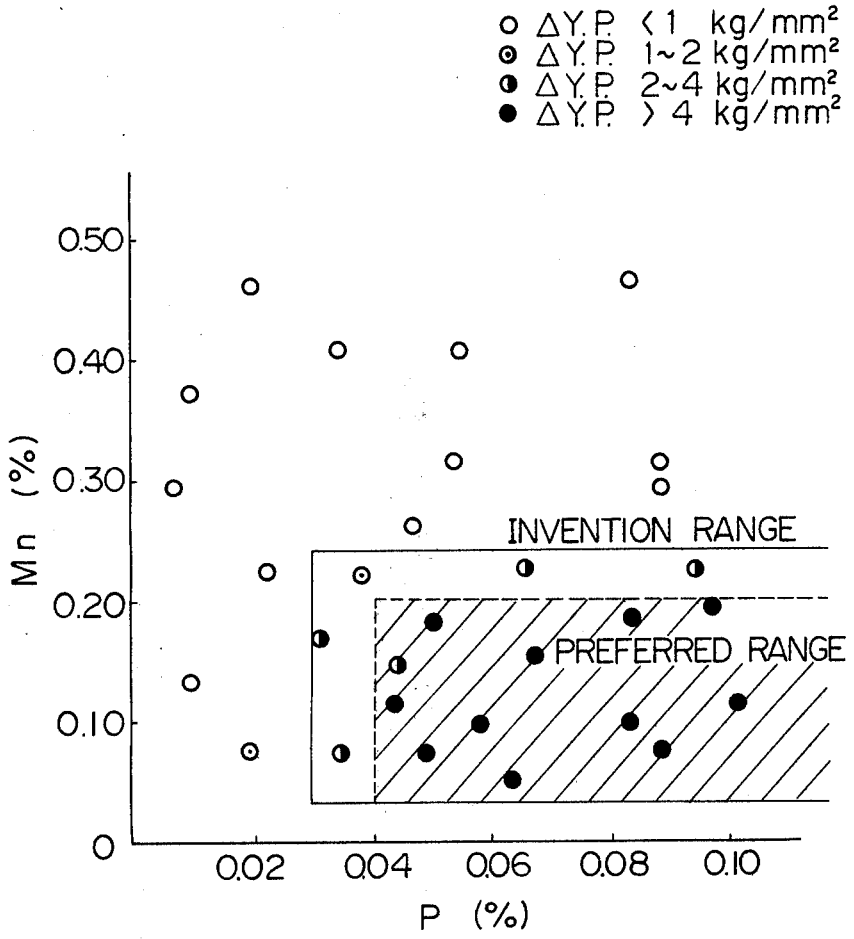

As is shown in FIG. 6, the steel strip having the steel composition falling within the steel composition of this invention all shows ΔY.P. of more than 2 kg/mm$^2$. It can be said that ΔY.P. is always more than 4 kg/mm$^2$ in case phosphorus is more than 0.04% and manganese is less than 0.20%.

EXAMPLE 4

Steel melts having the compositions shown in Table 1 below were prepared in a converter and the resulting steels were subjected to hot rolling, pickling, cold rolling, box annealing and temper rolling.

TABLE 1

| Steel | C | Si | Mn | P | S | sol. Al | N |
|---|---|---|---|---|---|---|---|
| A | 0.050 | 0.08 | 0.35 | 0.052 | 0.012 | 0.040 | 0.0045 |
| B | 0.050 | 0.08 | 0.18 | 0.011 | 0.010 | 0.034 | 0.0062 |
| C | 0.060 | 0.06 | 0.17 | 0.047 | 0.016 | 0.059 | 0.0060 |
| D | 0.009 | 0.01 | 0.14 | 0.086 | 0.011 | 0.073 | 0.0038 |

The finishing temperature of hot rolling was 900°–850° C., and the coiling temperature was 600°–550° C. The reduction in thickness in cold rolling was from 3.2 mm to 0,8 mm with a reduction in thickness of 75%. The annealing conditions include heating at a rate of 50° C./hr, soaking at 630°–800° C. for 5 hours and cooling in the temperature range of from 500° C. to 200° C. at a rate 100° C./hr on the average and in the temperature range of from 200° C. to room temperature at a rate of about 40° C./hr. Elongation given by temper rolling was 1.0%.

JIS No. 5 test pieces were cut from each of the resulting steel strips. ΔY.P. was determined as in Example 1 on each of the test pieces.

Figure 7:
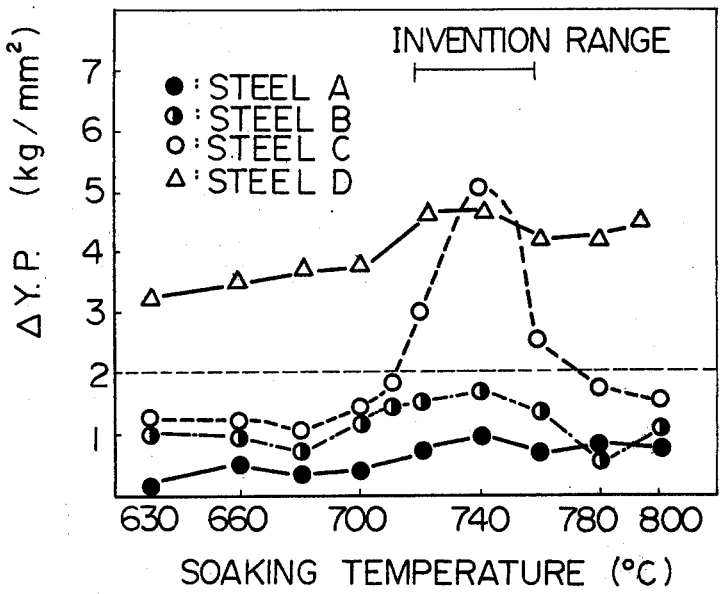
FIG. 7 is a graph plotting the data of ΔY.P. with respect to the soaking temperatures indicated.

FIG. 7 shows the relation between the soaking temperature and ΔY.P. with respect to each of Steels A, B, C and D. As is apparent from FIG. 7, Steel A containing as much as 0.35% of Mn and Steel B containing as low as 0.011% of P did not give ΔY.P. as much as 2 kg/mm$^2$. Of the steels containing suitable amounts of P and Mn, Steel C containing relatively a large amount of carbon (0.06% C) gave ΔY.P. of larger than 2 kg/mm$^2$ in case of a soaking temperature of higher than 720° C., and Steel D containing a relatively small amount of carbon (0.009% C) exhibited remarkably improved bake-hardenability indicated in term of ΔY.P. of higher than 3 kg/mm$^2$ in case the soaking temperature was higher than 630° C.

EXAMPLE 5

Steels C and D in Table 1 were prepared as in Example 4. However, in this example, the annealing and temper rolling were carried out as follows. The steel strips were annealed under conditions including heating at 50° C./hr, soaking at 740° C. for 5 hours and cooling in the temperature range of from 500° C. to 200° C. at a cooling rate varying from 6° C./hr to air cooling. After applying temper rolling with a reduction of 1%, the resulting steel strips were left at room temperature for a month. Thereafter, yield point elongation and ΔY.P. as in Example 1 were determined by the tensile test.

Figure 8:
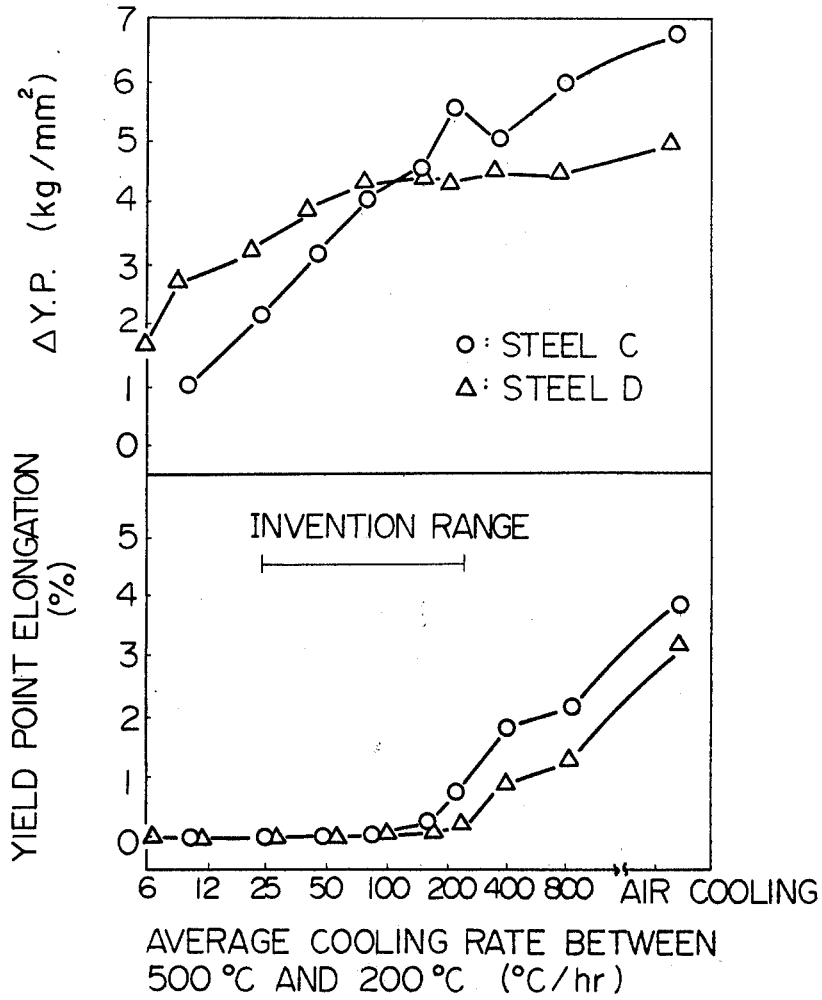
FIG. 8 is a graph plotting the date of ΔY.P. and yield point elongation with respect to the varying cooling rates in box-annealing.

The results are summarized in FIG. 8.

As is apparent from the data shown therein, when the cooling was carried out in the temperature range of from 500° C. to 200° C. at a rate of 25°–250° C./hr, the steel containing a relatively large amount of carbon (more than 0.020% C) did not show any yield point elongation, nor aging at room temperature. When the cooling was carried out in the temperature range of from 500° C. to 200° C. at a rate of 10°–250° C./hr, the steel containing a relatively small amount of carbon (less than 0.020% C), did not show any yield point elongation, nor aging at room temperature. In addition, since αY.P. was larger than 2 kg/mm$^2$, steel strips having improved dent resistance were obtained in accordance with this invention.

EXAMPLE 6

Steel melts having the compositions shown in Table 2 were prepared in a converter. The resulting steels E–J, except K were worked into slabs through a continuous casing process. Steel K was worked into slabs through ingot-making and slabbing. The resulting pieces of slab were heated at 1200°–1250° C. and hot rolled to a thickness of 2.8 mm with the finishing temperature of 820°–880° C. The coiling temperature was 580°–600° C. After pickling the cold rolling was applied to reduce the thickness to 0.7 mm. The cold rolled steel strips of Steels E and F were box-annealed in an open coil and the cold rolled steel strips of Steels G–K were box-annealed in a tight coil.

The annealing conditions for the open coil include heating at a rate of 70° C./hr, soaking at 720° C. for 4 hours, cooling in the temperature range of 720°–400° C. at a rate of 80° C./hr and in the temperature range of 400°–200° C. at a rate of 40° C./hr. On the other hand, the annealing conditions for the tight coil include heating at 40° C./hr, soaking at 680° C. for 20 hours, and cooling in the temperature range of 680°–400° C. at a rate of 60° C./hr and in the temperature range of 400°-200° C. at a rate of 20° C./hr. The atmosphere was in both cases mainly comprised of 8%$H_2$ plus $N_2$ and was non-decarburizing.

After annealing temper rolling to obtain an elongation of 1.2% was applied.

JIS No. 5 test pieces were cut from the resulting steel strips and were subjected to the tensile test in three directions. The data of αY.P. were also determined as in Example 1. Age-hardening at room temperature was evaluated in terms of the level of yield point elongation measured of specimens having been subjected to an accelerated aging at a temperature of 50° C. for 3 days.

The results are summarized in Table 3.

TABLE 2

| | C | Si | Mn | P | S | Sol. Al | N |
|---|---|---|---|---|---|---|---|
| E | 0.015 | 0.14 | 0.17 | 0.039 | 0.010 | 0.053 | 0.0062 |
| F | 0.007 | 0.05 | 0.19 | 0.063 | 0.005 | 0.071 | 0.0039 |
| G | 0.018 | 0.08 | 0.09 | 0.106 | 0.006 | 0.049 | 0.0058 |
| H | 0.010 | 0.01 | 0.10 | 0.053 | 0.015 | 0.042 | 0.0052 |
| I | 0.040 | 0.14 | 0.15 | 0.040 | 0.008 | 0.051 | 0.0083 |
| J | 0.008 | 0.04 | 0.17 | 0.013 | 0.008 | 0.063 | 0.0060 |
| K | 0.013 | 0.08 | 0.17 | 0.080 | 0.012 | 0.001 | 0.0028 |

TABLE 3

| | Yield Strength (kg/mm²) | Yield Strength (kg/mm²) | elong-ation (%) | r-value | ΔY.P. (kg/mm²) | aging at room temperature |
|---|---|---|---|---|---|---|
| invention | | | | | | |
| E | 21.3 | 37.0 | 42.0 | 1.58 | +4.9 | none |
| F | 19.0 | 33.8 | 46.0 | 1.89 | +5.5 | " |
| G | 23.8 | 40.5 | 38.5 | 1.67 | +4.0 | " |
| H | 20.1 | 36.5 | 43.0 | 1.63 | +2.8 | " |
| comparative | | | | | | |
| I | 24.5 | 39.5 | 39.0 | 1.40 | +0.3 | " |
| J | 19.5 | 33.5 | 46.0 | 1.56 | +0.3 | " |
| K | 22.6 | 37.1 | 42.0 | 1.26 | +5.9 | yes |

NOTE:
"none" means yield point elongation of less than 0.5%
"yes" means yield point elongation of 0.5% or more As is apparent from the data shown in Table 3 above, Steels E-H of this invention do not show aging at room temperature and have ΔY.P. of higher than 2 kg/mm². In addition, they have improved r-value and elongation. Though Steel H has a slightly low ΔY.P. because of small amount of Si, Steel H is satisfactory as a dent-resistant steel from a practical viewpoint.

On the contary, one of the comparative steels, Steel I has a low ΔY.P. and a low r-value inspite of a high content of carbon since the soaking temperature was as low as 680° C. Steel J had a low ΔY.P. because the P content is too small. The values of ΔY.P. of Steels I and J were smaller than 2 kg/mm². It cannot be said that the Steels I and J are dent-resistant steel strips. Steel K is rimmed steel with a low r-value, resulting in aging at room temperature.

EXAMPLE 7

Steel melts having the composition shown in Table 4 were prepared in a converter. The resulting steels were worked into slabs, which were heated at 1200°-1280° C. and then hot cooled. The finishing temperature was 850°-920° C. and the coiling temperature was 520°-600° C. After pickling the cold rolling was applied to reduce the thickness to 0.8 mm with a reduction in thickness of 75%. The cold rolled steel strip was then uncoiled and box annealed in a loose coil. The conditions of the box annealing included heating at a rate of 50° C./hr, soaking at 740° C. for 3-5 hours and cooling in the temperature range of from 500° C. to 200° C. at a rate of 80° C./hr on the average. After annealing temper rolling to obtain an elongation of 1% was applied.

On the test pieces cut from the annealing cold rolled steel sheets, yield point, tensile strength, r-value and increase in yield point due to baking (ΔY.P.) were obtained on the basis of experimental data of the tensile test in the rolling direction.

Some specimens were left at room temperature for a month after temper rolling. Thereafter, the yield point elongation was measured in the tensile test so as to determine whether aging at room temperature took place or not.

The results are summarized in Table 5 below.

TABLE 4

| | C | Si | Mn | P | S | Sol. Al | N |
|---|---|---|---|---|---|---|---|
| L | 0.04 | 0.01 | 0.15 | 0.047 | 0.016 | 0.059 | 0.0060 |
| M | 0.09 | 0.10 | 0.16 | 0.089 | 0.011 | 0.061 | 0.0081 |
| N | 0.04 | 0.14 | 0.44 | 0.058 | 0.011 | 0.049 | 0.0035 |
| O | 0.06 | 0.01 | 0.23 | 0.049 | 0.009 | 0.001 | 0.0028 |

TABLE 5

| | Yield strength (kg/mm²) | tensile strength (kg/mm²) | elong-ation (%) | r-value | ΔY.P. (kg/mm²) | aging at room temperature |
|---|---|---|---|---|---|---|
| L | 21.5 | 37.6 | 42.0 | 1.73 | 5.0 | none |
| M | 29.1 | 43.8 | 36.5 | 1.81 | 4.5 | " |
| N | 24.0 | 40.1 | 38.6 | 1.42 | 0.6 | " |
| O | 20.6 | 33.0 | 45.3 | 1.20 | 5.5 | yes |

As is apparent from the data shown in Table 5 above, the cold rolled steel strip produced in accordance with this invention, even though they were subjected to box-annealing, have improved bake-hardenability, high r-value and non-aging property at room temperature. On the contrary, Comparative Steel N had a low ΔY.P. because it contains a relatively large amount of Mn. Comparative Steel O has a low r-value and showed aging at room temperature because it contains a relatively small amount of sol. Al.

The above results teach that the combination of steel composition and cooling rate in the box-annealing is very important for the purpose of this invention.

EXAMPLE 8

On the steel compositions shown in Table 6, Example 4 was repeated. The box annealing conditions in this example included heating at a rate of 50° C./hr, soaking at 640°-780° C. for 5 hours and cooling in the temperature range of 500° C. to 200° C. at a rate of 70° C./hr on the average and in the temperature range of from 200° C. to room temperature at a rate of about 40° C./hr.

TABLE 6

| | C | Si | Mn | P | sol. Al | N | Nb |
|---|---|---|---|---|---|---|---|
| P | 0.10 | 0.11 | 0.14 | 0.081 | 0.069 | 0.0041 | 0.011 |
| Q | 0.09 | 0.14 | 0.11 | 0.016 | 0.044 | 0.0063 | 0.022 |
| R | 0.11 | 0.15 | 0.63 | 0.112 | 0.048 | 0.0047 | tr |

Steel P is the steel falling within this invention is in its composition. Steel Q contains phosphorus in an amount lower that required in this invention. Steel R contains manganese in an amount higher than that required in this invention and does not contain niobium. Steels Q and R are comparative ones.

On these steels, as in Example 1, ΔY.P. as well as tensile strength, elongation and r-value were measured. The results are summarized in FIG. 9.

Figure 9:
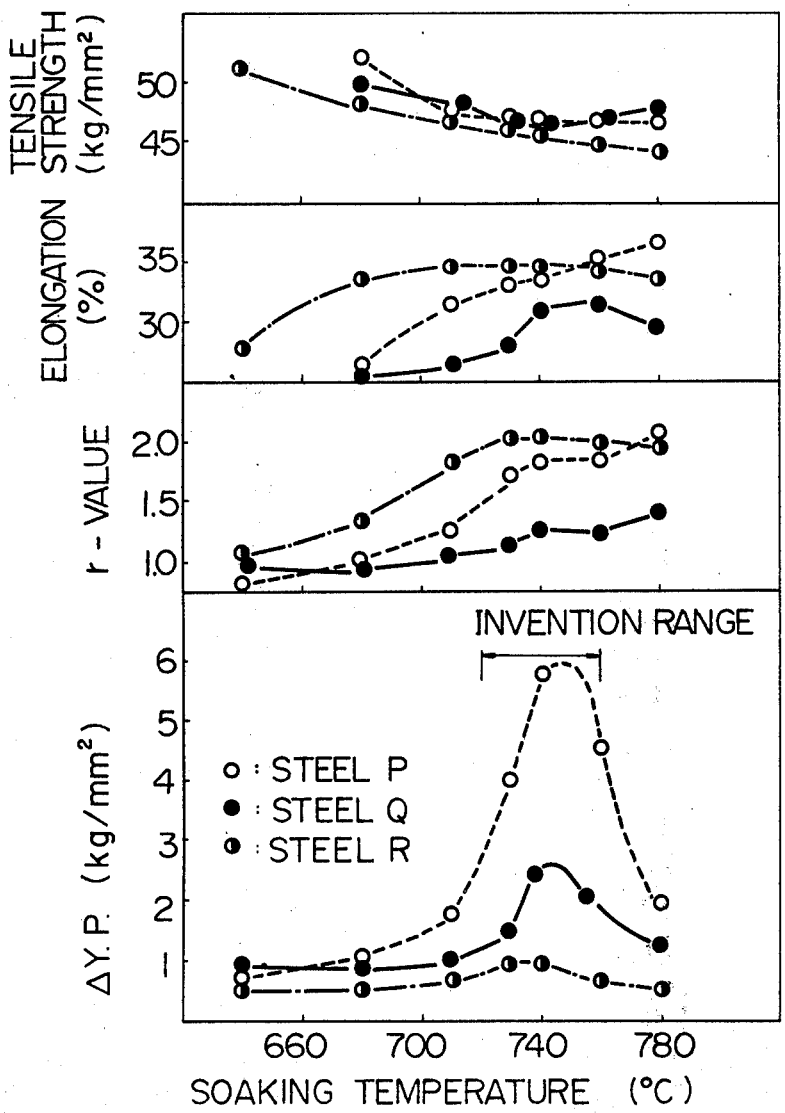
FIG. 9 is a graph plotting the test data obtained in Example 8 with respect to the varying soaking temperatures in box-annealing.

As is apparent from FIG. 9, all the steels showed substantially the same tensile strength in the level of 45–50 kg/mm$^2$ when the soaking temperature is 720°–760° C. However, Steel Q containing a small amount of P showed only a small elongation and/or r-value because of strengthened precipitation hardening due to NbC. Comparative Steel R containing a relatively large amount of Mn and fee from Nb showed an extremely low ΔY.P. value. In contrast, Steel P of this invention showed satisfactory values of elongation, r-value and ΔY.P. when the soaking temperature was 720°–760° C. These properties were well balanced, so the steel strip of this invention is particularly useful as steel strip for automobile.

EXAMPLE 9

Steels melts having the compositions shown in Table 7 were prepared in a converter. The resulting steels S–X were worked into slabs through a continuous casting process. The slabs were heated at 1200°–1280° C. and hot rolled to a thickness of 3.2 mm. The finishing temperature was 850°–900° C. The coiling temperature was 400°–450° C. After pickling, cold rolling was applied to reduce the thickness to 0.8 mm with a reduction in thickness of 75%. The resulting cold rolled steel strip was uncoiled and was box annealed in a loose coil. The box annealing conditions included heating at a rate of 50° C./hr, soaking at 740° C. for 5 hours and cooling in the temperature range of from 500° C. to 200° C. at a rate of 80° C./hr on the average. After annealing, temper rolling to obtain an elongation of 1.3% was applied.

On the test pieces cut from the resulting cold rolled steel strips, yield point, tensile strength, r-value and increase in yield point due to baking (ΔY.P.) were obtained on the basis of the experimental data of the tensile test in the rolling direction.

Some specimens were left at room temperature for a month after temper rolling. Thereafter, the yield point elongation was measured in the tensile test so as to determine whether aging at room temperature took place or not.

The results are summarized in Table 7.

TABLE 7

| | composition (weight %) | | | | | | | | | yield strength | tensile strength | elong-ation | | ΔY.P. | aging at room temp-erature |
|---|---|---|---|---|---|---|---|---|---|---|---|---|---|---|---|
| | C | Si | Mn | P | S | sol. Al | N | Nb | V | (kg/mm$^2$) | (kg/mm$^2$) | (%) | r-value | (kg/mm$^2$) | |
| invention | | | | | | | | | | | | | | | |
| S | 0.03 | 0.41 | 0.15 | 0.101 | 0.019 | 0.042 | 0.0060 | 0.007 | tr | 35.0 | 49.2 | 30.0 | 1.68 | 4.8 | none |
| T | 0.10 | 0.01 | 0.08 | 0.060 | 0.011 | 0.021 | 0.0042 | 0.022 | tr | 32.4 | 46.1 | 33.5 | 1.54 | 5.3 | " |
| U | 0.13 | 0.01 | 0.18 | 0.072 | 0.018 | 0.042 | 0.0053 | tr | 0.014 | 30.5 | 44.3 | 35.0 | 1.60 | 4.0 | " |
| V | 0.06 | 0.04 | 0.13 | 0.098 | 0.010 | 0.082 | 0.0046 | 0.012 | 0.008 | 35.1 | 51.8 | 28.0 | 1.51 | 4.6 | " |
| comparative | | | | | | | | | | | | | | | |
| W | 0.08 | 0.01 | 0.31 | 0.093 | 0.020 | 0.049 | 0.0043 | 0.018 | tr | 30.4 | 45.4 | 33.5 | 1.50 | 1.2 | " |
| X | 0.10 | 0.04 | 0.11 | 0.089 | 0.009 | 0.005 | 0.0021 | 0.010 | tr | 34.7 | 46.8 | 28.5 | 1.15 | 6.3 | yes |

As is apparent from the data shown in Table 7, Steels S–V of this invention all showed a relatively high tensile strength in the range of about 45–50 kg/mm$^2$. They also had a relatively high degree of elongation, r-value and ΔY.P. They did not show aging at room temperature. On the other hand, the Comparative Steels W containing a relatively large amount of Mn showed a low ΔY.P. and Comparative Steel X containing a relatively small amount of sol. Al showed a low r-value and showed aging at room temperature.

This invention has been described in detail in conjunction with its working examples. As is apparent therefrom, according to this invention a cold rolled steel strip having improved press formability and bake-hardenability can easily be produced at low cost.

The cold rolled steel strip produced in accordance with this invention can show increase in yield point during paint baking after press forming, giving improved dent resistance to the final product. In addition, in case Nb and/or V are added in a small amount cold rolled steel strip having tensile strength higher than 40 kg/mm$^2$ and the improved properties mentioned above can be obtained.

The cold rolled steel strip produced in accordance with this invention is particularly suitable for outer and inner panels of automobiles, which recently have been required to be lighten in weight to improve mileage. The application of this steel strip, however, is not limited thereto. They are also suitable for home electric appliances and the like which require a relatively high level of tensile strength.

What is claimed is:

1. A method of producing a cold rolled steel strip having improved press formability and bake-hardenability, in which the steel consists essentially of:

C: 0.003–0.150%,
Si: not more than 1.50%,
Mn: 0.03–0.25%,
P: 0.03–0.20%,
sol. Al: 0.02–0.15%, N: 0.002–0.015%,
balance being iron and incidental impurities comprising hot rolling, pickling, cold rolling, then passing the resulting steel strip to a box annealing furnace in which the steel strip is subjected to recrystallization annealing by heating it at a temperature lower than 760° C. but higher than the recrystallization temperature of the steel in a steel composition area comprised of a single phase of ferrite or a dual phase of ferrite plus austenite in the Fe-C binary phase diagram and cooling it in the temperature range of from 500° C. to 200° C. at an average cooling rate of 10°–250° C./hr, and then temper rolling the annealed steel strip.

2. A method of producing a cold rolled steep strip having improved press formability and bake-hardenability, in which the steel consists essentially of:

C: 0.003–0.020%,
Si: not more than 1.50%,
Mn: 0.03–0.25%,
P: 0.03–0.20%,
sol. Al: 0.02–0.15%,
N: 0.002–0.015%,
balance being iron and incidental impurities comprising hot rolling, pickling, cold rolling, then passing the resulting steep strip to a box annealing furnace in which the steel strip is subjected to recrystallization annealing by heating it at a temperature of from 600°–760° C. and cooling it in the temperature range of from 400° C. to 200° C. at an average cooling rate of 10°–250° C./hr, and then temper rolling the annealed steel strip.

3. A method defined in claim 2, in which the steel composition consists essentially of:

C: 0.003–0.020%,
Si: 0.04–0.20%,
Mn: 0.03–0.20%,
P: 0.04–0.20%,
sol: Al: 0.02–0.15%,
N: 0.002–0.015%,
balance being iron and incidental impurities.

4. A method of producing a cold rolled steel strip having improved press formability and bake-hardenability, in which the steel consists essentially of:

C: 0.020–0.150%
Si: not more than 1.50%,
Mn: 0.03–0.25%,
P: 0.03–0.20%,
sol. Al: 0.02–0.15%,
N: 0.002–0.015%,
balance being iron and incidental impurities comprising hot rolling, pickling, cold rolling, then passing the resulting steel strip to a box annealing furnace in which the steel strip is subjected to recrystallization annealing by heating it at a temperature of 720°–760° C. and cooling it in the temperature range of from 500° C. to 200° C. at an average cooling rate of 25°–250° C./hr, and then temper rolling the annealed steel strip.

5. A method defined in claim 4, in which the steel composition consists essentially of:

C: 0.020–0.150%,
Si: 0.04–0.20%,
Mn: 0.03–0.20%,
P: 0.04–0.20%,
sol. Al: 0.02–0.15%,
N: 0.002–0.015%,
balance being iron and incidental impurities.

6. A method of producing a cold rolled steel strip having improved press formability and bake-hardenability, in which the steel consists essentially of:

C: 0.02–0.150%,
Si: not more than 1.50%,
Mn: 0.03–0.25%,
P: 0.03–0.20%,
sol. Al: 0.02–0.15%,
N: 0.002–0.015%,
at least one of 0.003–0.030% Nb and 0.005–0.030% V, in total not more than 0.030%,
balance being iron and incidental impurities, comprising hot rolling, pickling, cold rolling, then passing the resulting steel strip to a box annealing furnace in which the steel strip is subjected to recrystallization annealing by heating it at a temperature of 720°–760° C. and cooling it in the temperature range of from 500° C. to 200° C. at an average cooling rate of 25°–250° C./hr, and then temper rolling the annealed steel strip.

7. A method defined in claim 6, in which the steel composition consists essentially of:

C: 0.02–0.150%,
Si: 0.04–0.20%,
Mn: 0.03–0.20%,
P: 0.04–0.20%,
sol. Al: 0.02–0.15%,
N: 0.002–0.015%,
at least one of 0.003–0.30% Nb and 0.005–0.030% V, in total not more than 0.030%,
balance being iron and incidental impurities.

* * * * *